US007294954B2

(12) United States Patent
Syms

(10) Patent No.: US 7,294,954 B2
(45) Date of Patent: Nov. 13, 2007

(54) MICRO-ENGINEERED ELECTRON MULTIPLIERS

(75) Inventor: Richard Syms, London (GB)

(73) Assignee: Microsaic Systems Limited, London (GB)

( * ) Notice: Subject to any disclaimer, the term of this patent is extended or adjusted under 35 U.S.C. 154(b) by 361 days.

(21) Appl. No.: 11/032,546

(22) Filed: Jan. 10, 2005

(65) Prior Publication Data

US 2005/0151054 A1 Jul. 14, 2005

(51) Int. Cl.
*H01J 40/00* (2006.01)

(52) U.S. Cl. ..... 313/103 CM; 313/105 CM

(58) Field of Classification Search ..... 313/532–535, 313/103 R, 103 CM, 104, 105 CM
See application file for complete search history.

(56) References Cited

U.S. PATENT DOCUMENTS

| | | | |
|---|---|---|---|
| 4,482,836 | A | 11/1984 | Washington et al. |
| 4,990,827 | A | 2/1991 | Ehrfeld et al. |
| 5,501,893 | A | 3/1996 | Laermer et al. |
| 5,544,772 | A | 8/1996 | Soave et al. |
| 5,568,013 | A | 10/1996 | Then et al. |
| 5,618,217 | A | 4/1997 | Then et al. |
| 5,997,713 | A | 12/1999 | Beetz, Jr. et al. |
| 6,384,519 | B1 | 5/2002 | Beetz, Jr. et al. |

OTHER PUBLICATIONS

Bean K.E. "Anisotropic Etching Of Silicon," IEEE Trans.on Electron Devices vol. ED-25, No. 10, pp. 1185-1193 (1978).

Fijol J.J., Then A.M., Tasker G.W., Soave R.J., "Secondary Electron Yield of $SiO_2$ and $Si_3N_4$ Thin-Films For Continuous Dynode Electron Multipliers," Appl. Surf. Sci. 48-49: pp. 464-471 (1991).

Beetz C.P., Lincoln B., Winn D.R., Segall K., Vasas M., Wall D. "Diamond Film Optical, X-Ray and Particle Detectors," IEEE Trans.on Nucl. Sci. vol. 38, No. 2, pp. 107-109 (1991).

Ehrfeld W., Münchmeyer D., "Three-Dimensional Microfabrication Using Synchrotron Radiation," Nucl. Instrum. & Meth. in Physics Research, vol. A303, pp. 523-532 (1991).

Shank S.M., Soave R.J., Then A.M., Tasker G.W., "Fabrication Of High Aspect Ratio Structures For Microchannel Plates," J. Vac.Sci. Tech. vol. B13 (6), pp. 2736-2740, Nov./Dec. (1995).

Guckel H., "High-Aspect-Ratio Micromachining Via Deep X-Ray Lithography," Proc. IEEE vol. 86, No. 8, pp. 1586-1593, Aug. (1998).

(Continued)

*Primary Examiner*—Vip Patel
(74) *Attorney, Agent, or Firm*—McDermott Will & Emery LLP

(57) ABSTRACT

This invention provides for a simple method of fabricating miniature electron multipliers, in an in-plane configuration suitable for use with miniature analytic instruments such as mass filters. The materials involved are predominantly silicon and compatible oxides, allowing the possibility of integration with a mass filter formed in a similar materials system. The materials are selected simultaneously to withstand high voltages and to enhance secondary electron emission. Fabrication is based on standard planar processing methods. These methods also allow the construction of an integrated set of bias resistors in a multi-electrode device, so that the device may be operated from a single high-voltage source.

22 Claims, 5 Drawing Sheets b)

OTHER PUBLICATIONS

Hynes A.M., Ashraf H., Bhardwaj J.K., Hopkins J., Johnson I., Shepherd J.N., "Recent Advances In Silicon Etching For MEMS Using the ASE™ Process," Sensors and Actuators vol. 74, pp. 13-17 (1999).

Fukuda D., Inoue M., Takahashi H., Nakazawa M., Kawarabayashi J., Hirata Y., Numazawa T., Haga T., "Development Of A Micro-Array-Type Electron Multiplier," Nucl. Instrum. Meth. in Physics Research, vol. A436, pp. 196-200 (1999).

Inoue M., Fukuda D., Takahashi H., Nakazawa M., Kawarabayashi J., Hirata Y., Numazawa T., Haga T., "Development Of A New Position Sensitive Electron Multiplication Device Fabricated By LIGA Process," Microsystems Technologies, vol. 6, pp. 90-93 (2000).

Beetz C.P., Boerstler R., Steinbeck J., Lemieux B., Winn D.R., "Silicon-Micromachined Microchannel Plates." Nucl. Instrum. & Meth. in Physics Research, vol. A442, pp. 443-451 (2000).

Badman E.R., Cooks R.G., "Special Feature: Perspective -Miniature Mass Analyzers," J.Mass. Spect. vol. 35, pp. 659-671 (2000).

Darling R.B., Scheidemann A.A., Bhat K.N., Chen T.C., "Micromachined Faraday Cup Array Using Deep Reaction Ion Etching," Sensors and Actuators vol. A95, pp. 84-93 (2002).

a)

b)

a)

b)

c)

a)

b)

MICRO-ENGINEERED ELECTRON MULTIPLIERS

This application claims priority from British Application No. GB0400399.2, filed 9 Jan. 2004 (incorporated by reference herein).

FIELD OF THE INVENTION

The invention relates to electron multipliers and particularly to electron multipliers formed in a Microelectromechanical system (MEMS) environment.

BACKGROUND

Originally developed for early TV cameras, electron multipliers are of considerable importance in low-signal light detection, night vision and mass spectrometry, and in instrumentation for high-energy physics. They provide an analogous function to the erbium doped fibre amplifier in optical communications, namely low-noise, high gain pre-detector amplification. There are a wide variety of different configurations, including discrete dynode devices and mesh multipliers, and continuous dynode devices such as microchannel plates and channeltron multipliers. Variants such as the Gas Electron Multiplier (GEM) are used for particle detection. Some types (e.g. microchannel plates) amplify photoelectrons from an image, while others (e.g. channeltrons) are single-channel devices for instrumentation.

Many materials have been investigated as secondary emissive layers in electron multipliers. Discrete dynode devices typically use metal or semiconductor surfaces, while channeltron devices use reduced lead silicate glasses and microchannel plates use fused arrays of glass tubes or anodically etched alumina. Many other materials have been investigated, including Si, $SiO_2$, $Si_3N_4$ (Fijol 1991) and thin film diamond (Beetz 1991).

The work function of the material determines the secondary electron yield (which is typically in the range 1.5-8) and the energy required for peak electron emission (which is typically of the order of 100 V-200 V). A cascade of emission events involving total voltages of more than 1 kV is normally required to obtain a high overall gain. In a discrete dynode device, the necessary voltages may be provided from a single voltage source by a chain of biasing resistors, which are normally external to the device.

If the material system can withstand such a large voltage, gains of up to $10^6$ are possible. In a discrete dynode device, the emitting surfaces are spaced by insulator material. In a continuous dynode device, the voltage is dropped along the emitting material itself, which must be partially conducting to be able to re-supply the secondary electrons from the external circuit. This dual function is achieved by using an activated surface backed by a partially conducting layer.

Microelectromechanical systems (MEMS) technologies potentially offer considerable advantages for electron multipliers, since they allow the fabrication of very high aspect ratio structures such as channels. For example, the German LIGA (standing for Lithographie, Galvanoformung, Abformung) process is a method of fabricating near-vertical deep features by electroplating in a mould formed by exposure of resist to synchrotron radiation (Ehrfeld et al. 1991; Guckel et al. 1998). Features with arbitrary shapes may be formed, in an orientation normal to the substrate plane; however, the process is expensive, and the features are formed in non-silicon materials such as electroplated metal. Although these materials can be modified with additional surface coatings, the choice of coatings that may be used for secondary electron emission is restricted.

Anisotropic etching such as that described in Bean (Bean 1978) is a method of fabricating high aspect ratio structures in silicon, which potentially allows the fabrication of silicon-based surfaces for secondary emission. However, the range of possible features is limited, because the process forms structures that are bounded by specific crystal planes (typically, the <111> plane). As a result, it is not possible to form arbitrary features orientated normal to the substrate plane.

Deep reactive ion etching (DRIE) is an alternative and more flexible method of forming near vertical features in silicon. The process involves the cyclic use of alternate etching and passivation steps (U.S. Pat. No. 5,501,893; Hynes et al. 1999). In the etch step, a reactive plasma derived from $SF_6$ is used to remove silicon. Although the etching is actually isotropic, lateral erosion is prevented by deposition of a polymer (derived from $C_xF_y$) in the passivation step. To re-initiate etching, fluorine radicals first etch the base of the passivation, and then the silicon itself. High etch rates (of the order of 4 μm/min) and depths of >500 μm may be achieved, with wall angles of >89°. The selectivity to oxide is extremely high, so that a glass or oxide layer can act as an etch stop.

There has been some effort to apply the methods above to the fabrication of electron multipliers. For example, U.S. Pat. No. 4,990,827 describes a discrete dynode multiplier, which is to be formed by the LUGA process. However, it is unclear whether the device was actually fabricated, and issues relating to suitable materials do not seem to have been addressed. LIGA has been used to fabricate slant-hole detectors for high-energy physics (Fukuda et al. 1999; Inoue et al. 2000). In both these cases, the detectors were through-wafer devices.

Microchannel plates have also been formed, by etching silicon, in an attempt to develop low-cost night-vision equipment. For example, U.S. Pat. No. 4,482,836, U.S. Pat. No. 5,618,217, U.S. Pat. No. 6,384,519 and U.S. Pat. No. 5,997,713 all describe microchannel plates constructed from stacked Si wafers which have been etched by a variety of methods including anisotropic etching, and electrochemical etching. U.S. Pat. No. 5,544,772 describes a simpler through-wafer multiplier, in which a single Venetian blind electrode is fabricated by etching of silicon. U.S. Pat. No. 5,568,013 describes an alternative configuration, in which amplification takes place within etched channels, which lie in the plane of the silicon wafer. Finally, the use of DRIE for forming high-aspect ratio channels in a through-wafer multiplier has been extensively explored (Shank 1995; Beetz 2000). Arrays of Faraday cup detectors have also been formed by DRIE (Darling 2002).

There is considerable demand for small single-channel multipliers to act as detectors in vacuum gauges and miniature vacuum instruments such as mass spectrometers. The latter are rapidly assuming importance as portable drugs and explosives detectors in the global effort against crime and terrorism. Microengineered mass filters have now been demonstrated as crossed-field, ion trap, quadrupole and time-of-flight devices (Badman et al. 2000); however, very little attention has been paid to the equally important problem of detector miniaturisation and integration.

In fact, detectors for miniature analytic instruments differ from microchannel plates in an important respect. To obtain sufficient selectivity from a microengineered mass filter, the ions normally travel parallel to the wafer plane, so that a sufficiently long ion path is achieved. Any compatible detector should therefore have a similar format, i.e. in-plane ion and electron paths. In such an arrangement, it is then possible to develop complex electrode structures by surface patterning and etching, and to modify or coat the exposed surfaces to enhance material properties such as secondary electron emissivity or resistivity. However, to date no such structures are available.

Increasingly, miniature analytic instruments are being constructed from silicon compatible materials using planar processing. However, the electron multiplier devices described above are generally not compatible with such a scheme. Connection to the individual electrodes is also complex, requiring many separate electrical wires. There is therefore a need for a simple method of forming secondary electron multipliers in a compatible format.

SUMMARY OF THE INVENTION

This invention provides for a simple method of fabricating miniature electron multipliers in an in-plane configuration for use with miniature analytic instruments such as mass filters. The materials involved are predominantly silicon and compatible oxides, thereby allowing the possibility of integration with a mass filter formed in a similar materials system. The materials are selected simultaneously to withstand high voltages and to enhance secondary electron emission. The fabrication system and methodology of the present invention also allows the construction of an integrated set of bias resistors in a device containing multiple electrodes, so that the device may be operated from a single high-voltage source. These features overcome many of the drawbacks in the prior art described above.

In a first embodiment a MEMS electron multiplier device is provided, the device comprising:

- a substrate formed at least partially from an insulating material,
- a semiconducting material provided on an upper surface of the substrate,
- a plurality of electrodes formed by selectively etching the semiconducting material, at least one of the electrodes being adapted to provide, in use, secondary electron emission on interaction with one or more electrons, and
- wherein the plurality of electrodes are formed with their emissive surfaces substantially perpendicular to the insulating substrate.

The electrodes are desirably geometrically arranged and electrically biased to operate by cascaded emission of secondary electrons in a direction parallel to the substrate plane.

The semiconducting material is preferably silicon.

The electrodes are typically provided by deep reactive etching, the etching of the semiconducting material effecting the formation of a plurality of upstanding elements having side walls upon which, in use, the electrons are incident thereupon.

The electrode etching may be carried out to different depths in different regions.

Preferred embodiments may have each of the electrodes formed as a 'Venetian blind' structures, each of the blinds having a plurality of elements, the individual elements of each blind being electrically coupled to one another.

In such embodiments, each of the plurality of elements defining or forming a Venetian blind structure is desirably coupled to an adjacent element of the Venetian blind structure by a bridge formed in the semiconducting material. Each of the elements is desirably defined by an upstanding feature etched in the semiconducting layer.

Preferably, each of the elements forming a Venetian blind structure is formed at an angle offset from the intended path of incoming electrons thereby increasing the probability of interaction with incoming electrons.

The electrodes may be provided in a geometry comprising a series of planar or curved surfaces.

The insulating material of the wafer is preferably selected from one or more of glass, silica, or oxidised silicon.

Each of the plurality of electrodes are desirably formed by etching techniques and the semiconducting surfaces of the formed electrodes are oxidised after etching.

Such oxidised surfaces or coatings may be doped with an additional material to enhance secondary electron emission. The oxide surface may also be annealed in hydrogen or some other reducing agent to enhance secondary electron emission.

The first electrode may be electrically biased to act as a conversion dynode for positive or negative ions, thus enabling the device to act as a positive or negative ion detector.

Certain embodiments may electrically couple adjacent electrodes to one another by a series of semi-conducting links. The semi-conducting links may be connected to act as bias resistors. Oxidation may be used to increase the effective resistance of the semiconducting links. It will be appreciated that the bias resistors may form a set of resistors linking and biasing a dynode chain.

Certain applications may require a combination of two or more multiplier devices by stacking so as to increase the effective input aperture.

The electrodes may be, in other embodiments, provided with an additional photo-emissive layer capable of ejecting an electron when struck with a photon such that the device may be used to detect X-rays and/or photons.

The invention also provides a method of forming a MEMS electron multiplier device, the method comprising the steps of:

a) Providing a wafer having a substrate and a silicon layer disposed on an upper surface of the substrate,
b) Patterning and etching the wafer to form a plurality of electrodes in the silicon layer,
c) Oxidising the etched silicon structure,
d) Annealing the oxidised silicon structure so as to provide enhanced secondary electron emission functionality,
e) Further etching the wafer to provide exposed areas for locating one or more contact pads, and
f) Providing one or more contact pads in the exposed areas.

These and other features of the present invention will be better understood with reference to the following drawings.

DETAILED DESCRIPTION OF THE INVENTION

Figure 1:
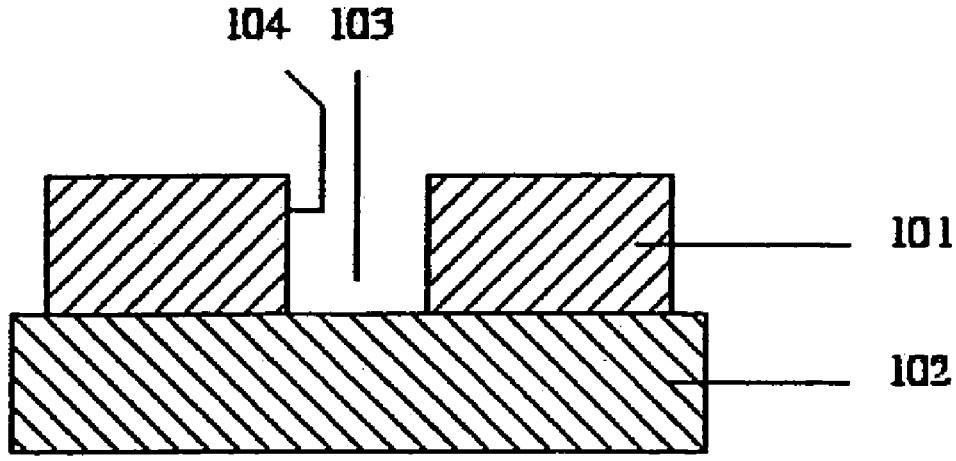
FIG. 1*a* shows in schematic form the formation of vertically etched features in a silicon-on-glass structure, as viewed in a cross section of the structure.
FIG. 1*b* shows in schematic form the formation of vertically etched features in bonded silicon-on-insulator materials, as viewed in a cross section of the structure.
Figure 1:
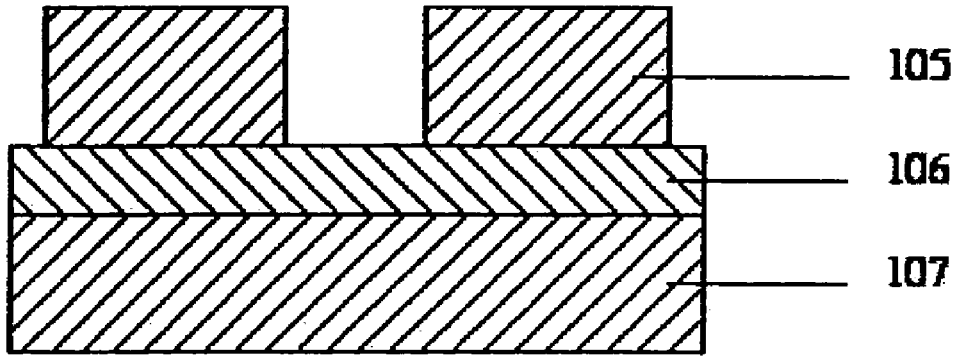
Figure 2:
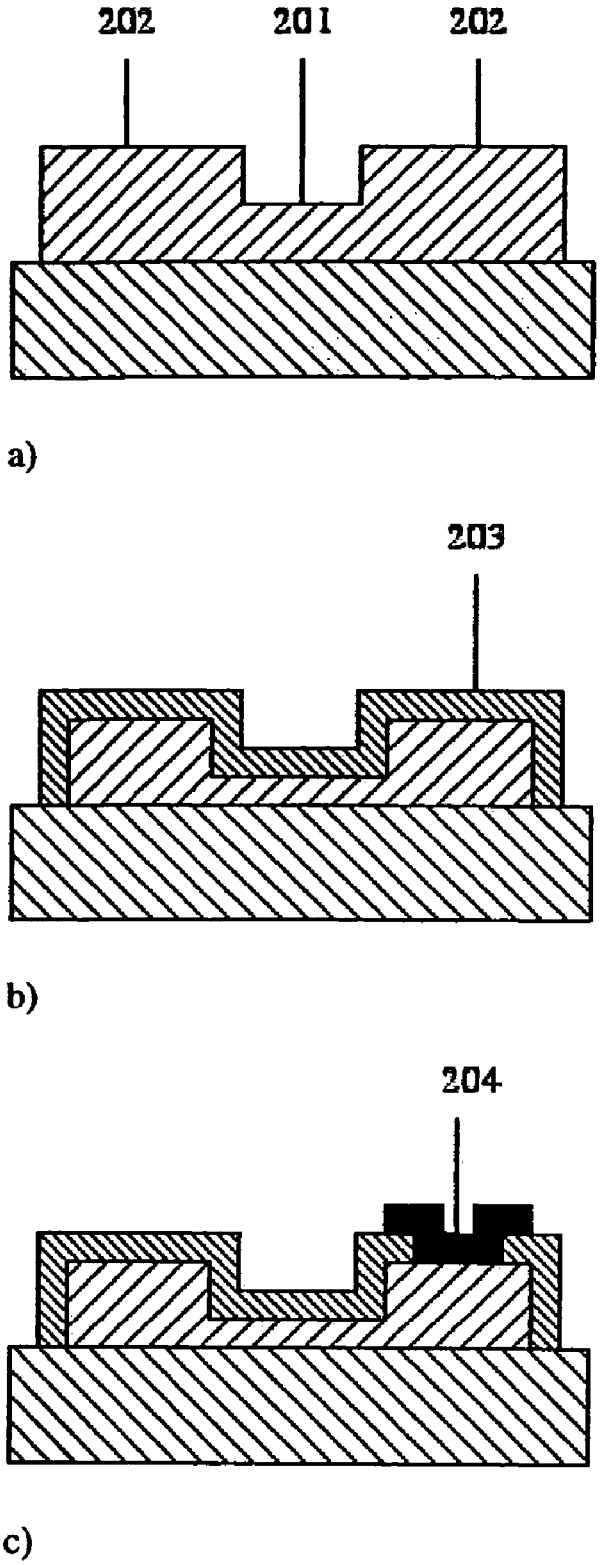
FIG. 2*a* shows the formation of bridging features by multi-step etching of a bonded silicon layer, as viewed in a cross section of the structure.
FIG. 2*b* shows the modification of the silicon surface of FIG. 2*a* by oxidation.
FIG. 2*c* shows the subsequent modification of the structure of FIG. 2*b* by the formation of contacts.
Figure 3:
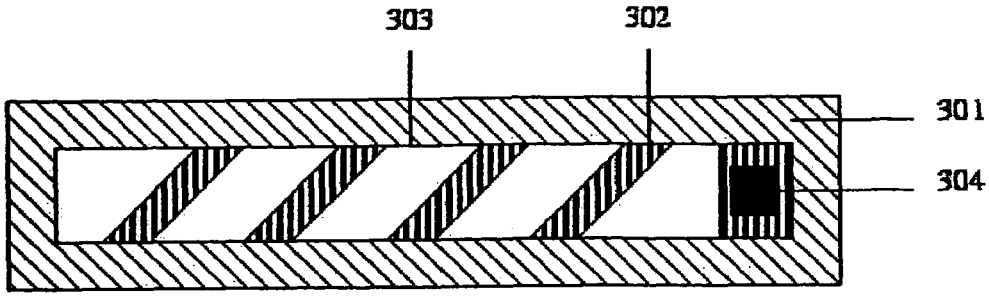
FIG. 3*a* shows an example of a single 'Venetian blind' electrode structure formed by two-step etching of a bonded silicon layer, as viewed in plan.
FIG. 3*b* is a 3 dimensional view of the single Venetian blind electrode structure shown in FIG. 3*a*.
FIG. 3*c* shows the use of a cascade of Venetian blind electrodes in a multi-stage secondary electron multiplier, again as seen from above and in plan.
Figure 3:
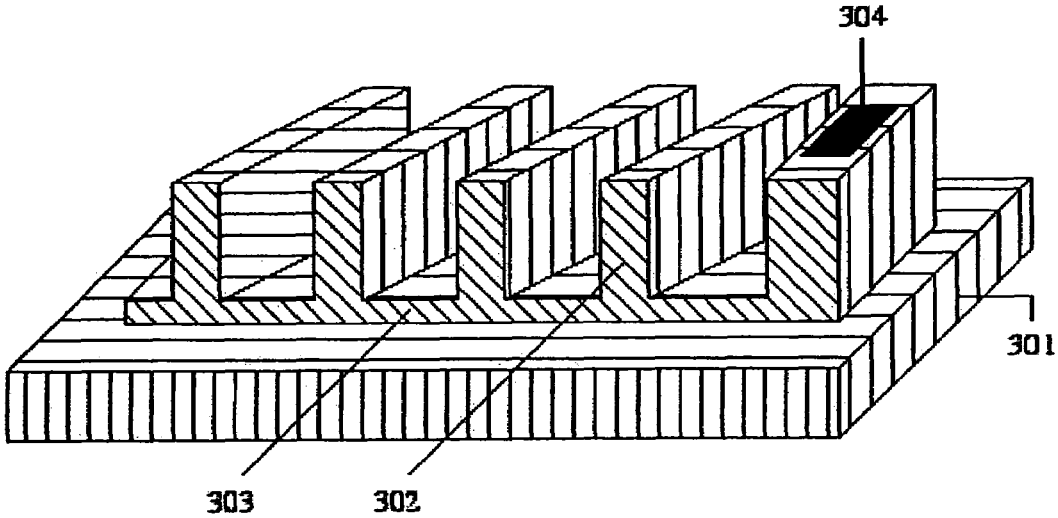
Figure 3:
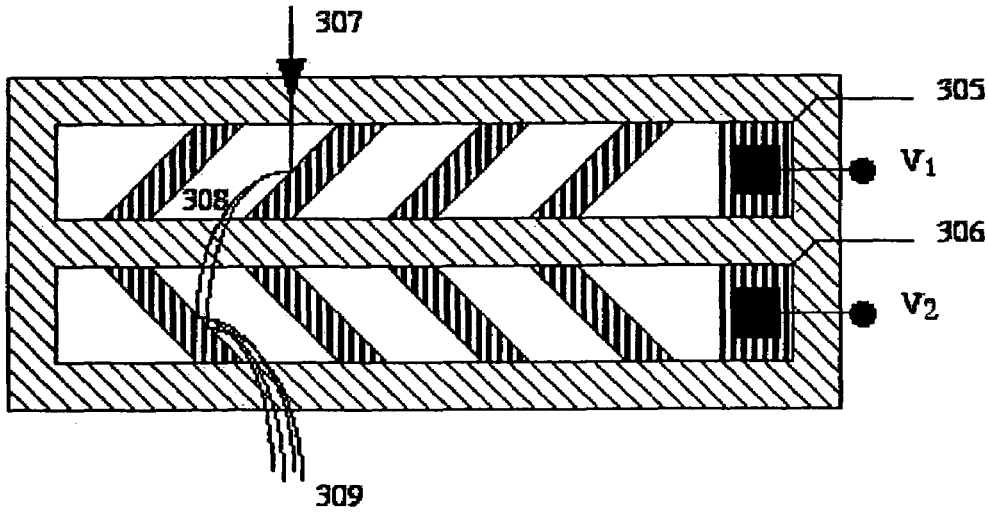

A detailed description of the invention is now provided, with reference to FIGS. 1-5.

FIG. 1*a* shows a cross-section of a silicon-on-glass wafer, which consists of a first material provided by a silicon layer 101 bonded to a second material provided by a glass or silica layer 102. The first material is a semiconductor, which may be converted into an insulator with enhanced secondary emission properties by oxidation and subsequent annealing at high temperature in hydrogen gas. It will be appreciated that in this context, the hydrogen is acting as a reducing agent and that other reducing agents could equivalently be used for specific applications. The second layer provides an insulating substrate. Using a single layer of patterning, the silicon layer 101 may be structured by deep reactive ion etching (DRIE) to form vertical features 103, stopping at the interface between the two materials. It will be appreciated that each vertical feature forms a structure with sidewalls 104 upstanding and substantially perpendicular to the plane of the substrate.

FIG. 1*b* shows a similar structure formed in bonded silicon-on-insulator (BSOI) material. This material consists of a silicon layer 105, which is bonded to an oxidised silicon wafer, such that a silica layer 106 is also provided with a silicon layer 107 on its lower surface. This configuration also provides a semiconducting layer on an insulating layer, but has a semiconducting substrate as its base. Either of the configurations of FIG. 1*a* or 1*b* could be used to provides a suitable starting point for construction of an electron multiplier as described in the present invention, although as will be appreciated by those skilled in the art improved electrical breakdown performance is expected from the use of a silicon-on-glass substrate. This material is therefore shown in the remaining diagrams; however similar devices may clearly be constructed using BSOI structures such as those shown in FIG. 1*b*.

Using a more complicated fabrication scheme based on two layers or more of patterning, the silicon layer may be completely etched down to the insulating glass substrate in some regions, and only partially etched in others. This process can leave linking bridges of material 201 between otherwise isolated and upstanding features 202 as shown in FIG. 2*a*.

Similarly to that described with reference to FIG. 1, once the desired features have been etched, the exposed silicon surface may be converted to silicon dioxide 203, as shown in FIG. 2*b*. Gaseous dopants may also be incorporated in the oxidising environment to from doped oxide layers and multi-component glasses such as lead silicate glasses. The silica may then be further processed, for example, although not exclusively, by annealing in hydrogen gas, to enhance secondary electron emission. Electrical connections may then be provided to the etched silicon features by locally removing the upper silica surface layer and depositing a contact pad formed from a suitable metal 204, as shown in FIG. 2*c*.

By combining these processing steps, structures of the type shown in FIGS. 3*a* and 3*b* may be fabricated. Here an insulating substrate 301 is used to carry an electrode structure defined by a plurality of etched features 302 linked by bridges 303 and carrying a contact pad 304. Such a structure is adapted to intercept incoming electrons and the etched features are therefore formed at an angle offset from the intended incident path of the electrons, which are desirably travelling parallel to and just above the substrate plane.

The slanted orientation of the etched features 302 forms a plurality of surfaces that may intercept incoming electrons, the electrons impacting on the sidewalls of the etched features. Each of the etched features or elements are electrically connected or coupled by the bridges 303 in an arrangement known as a 'Venetian blind' electrode, such that the electrode includes a plurality of elements. It will be appreciated that each feature 302 provides one inclined electrode with two surfaces, front and back, and a set of features 302 linked by bridges 303 forms a Venetian blind.

Electrical coupling between each of the electrodes 302 is provided by the intrinsic semiconducting nature of the materials forming the partially etched bridge 303, and no external wiring or electrical wiring is required. Other electrode arrangements based on fully and partially etched features that give rise to simpler planar or curved emissive surfaces are clearly possible, and it will be appreciated that it is not intended to limit the present invention to any one specific geometrical configuration.

A number of such electrodes may be arranged to form a discrete dyrnode electron multiplier, as shown in FIG. 3*c*. Here two Venetian blind electrodes 305 and 306 are arranged on the same substrate, and connected to applied voltages $V_1$ and $V_2$. The voltage $V_1$ is chosen to be of suitable sign and magnitude to accelerate an electron 307 towards the first electrode 305, so that it has sufficient kinetic energy to generate secondary elections 308 after impact. The number of secondary electrons will usefully be greater than the number of primary electrons. The voltage $V_2$ is chosen to be of suitable sign and magnitude to accelerate the secondary electrons thus created towards the second electrode 306, so that they in turn have sufficient kinetic energy to create further secondary electrons 309. This secondary electron multiplication process may be continued in further stages, to give rise to a desired overall electron gain.

Devices of this type may be used to detect electrons directly. With further modifications, apparent to the person skilled in the art, photons, X-rays and ions may also be detected. For example photons and X-rays may be detected by incorporating an additional photo-emissive layer capable of ejecting an electron when struck by a photon.

Ions may be detected by biasing the first electrode at an appropriate voltage so that it is capable of ejecting secondary electrons when struck by an ion.

In each case, a wide variety of electrode configurations may be used. For illustrative purposes, we now describe a discrete dynode multiplier based on a Venetian blind electrode layout; however, this layout is not exclusive and it is not intended to limit the present invention to any one configuration or application.

FIG. 4*a* shows one possible layout for a discrete dynode multiplier used to detect positive ions. A first Venetian blind electrode 401 is provided at the device input, and here biased to generate an initial shower of secondary electrons 403 from an incoming positive ion 402. The first electrode is known as a conversion dynode. The electrons are then multiplied by impact with a plurality of successive Venetian blind electrodes 404.

Figure 4:
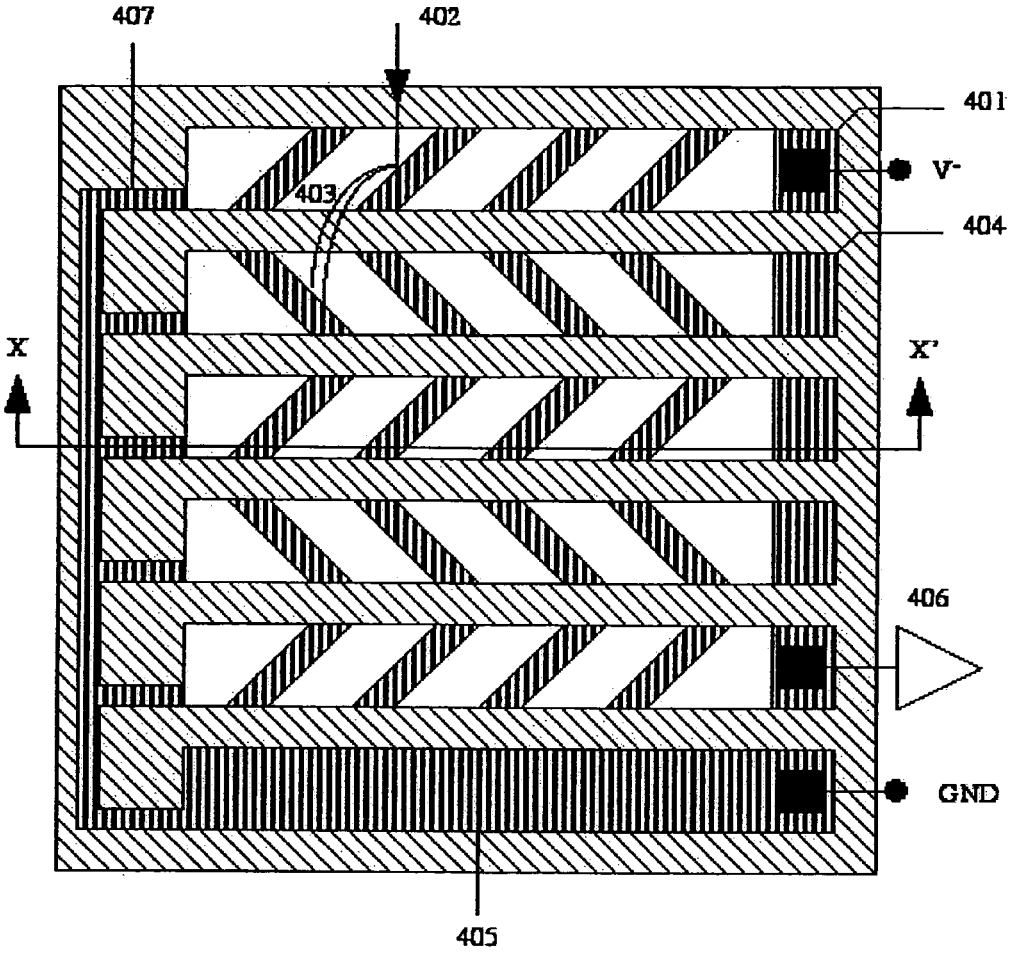
FIG. 4*a* shows in schematic form a layout of a Venetian blind secondary electron multiplier with integrated bias resistors, as viewed from above and in plan.
FIG. 4*b* shows a cross-section of the secondary electron multiplier in FIG. 4*a*, drawn along the line X-X'.
Figure 4:
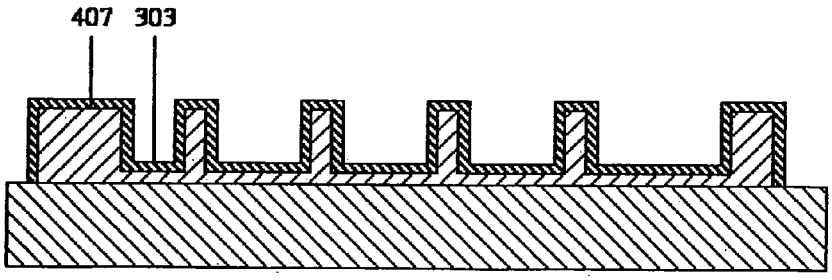

The electrodes are biased using a resistor chain 407 that is provided by etching a region of the silicon layer down to the substrate, to leave an upstanding portion of a suitable width. The width chosen will determine the resistance of the path formed by such a resistor chain. In the example of FIG. 4, and as will be evident from the cross-section provided by FIG. 4*b*, the resistor chain 407 is coupled to the bridges 303 so that a suitable potential difference is obtained between each one of the Venetian blind electrodes, using a single voltage source $V^{31}$. A grounded collector 405 is provided as a termination electrode, and the electron current is extracted from an amplifier 406 after a sufficient number of multiplication stages have been passed.

An important feature of this layout is that the resistor chain needed to establish the biasing of the separate electrodes in the multiplier may simultaneously be fabricated from silicon, for example as the meandered linkage 407. To reduce the quiescent current and the length of the bias resistor, the etched silicon layer will desirably have a high resistivity.

It will also be appreciated that other arrangements in which the Venetian blind electrodes or other electrode present are linked by differently configured resistor chains are possible, and that more than one resistor chain may be used to achieve a different biasing arrangement.

Because the etching processes used to form the electrode structure will necessarily have a minimum feature width, the achievable bias resistance may still be relatively low and the quiescent current may be correspondingly high. However, it is important to note that the operation of oxidation may be used to consume silicon from both sides of a vertically etched link, thus reducing its effective conducting width. This feature may be used to increase the resistance of the bias chain without excessively increasing its length.

Devices of this type may be used for electron or ion detection without further modification. However, two such devices may also be stacked together, with their etched surfaces touching, to double the effective feature height. This arrangement allows a larger input aperture without the requirement for an increased depth of etching.

A complete device may be constructed by combining standard patterning, etching, oxidation and metallisation steps. For illustrative purposes we now describe a suitable fabrication process; however, this process is not exclusive and different combinations of similar process steps may be used to obtain a similar result.

Figure 5:
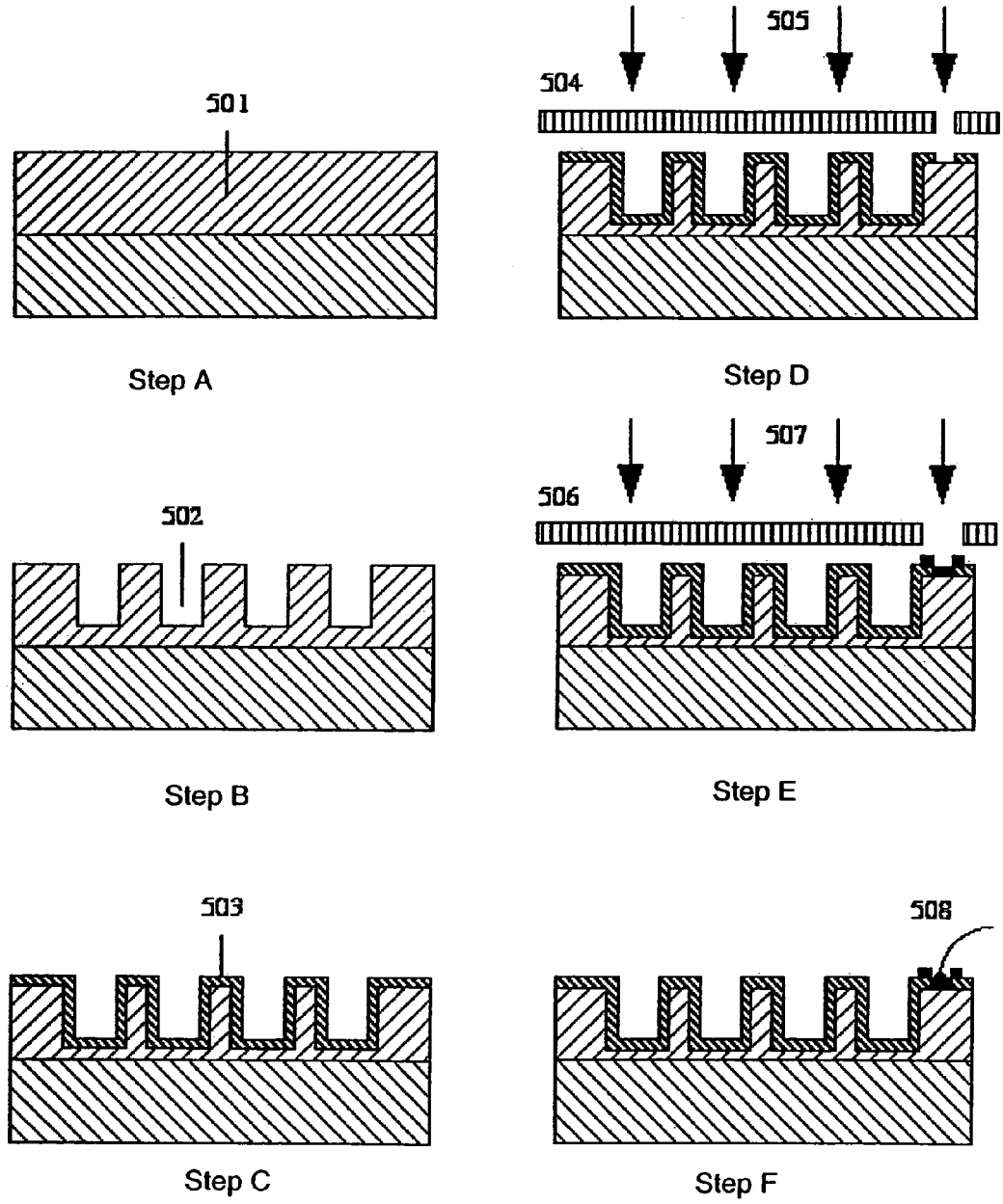
FIG. 5 is an example of a process for fabrication of secondary electron multipliers by deep reactive ion etching of bonded silicon material.

FIG. 5 shows an example process for forming connected electrodes that are etched to different depths on an insulating substrate and subsequently modified to enhance secondary electron emission and allow electrical connection. A multi-layered high-resistivity silicon-on-oxide wafer 501 is provided (Step A) and then patterned and etched using a two-layer patterning scheme to form the electrodes 502 in the silicon layer (Step B). Oxidation of the etched silicon structure and further thermal treatment is then used to form a surface layer 503 with enhanced secondary electron emission (Step C). Etching through a first stencil mask 504 using a reactive beam of ions 505 is used to open windows in the oxide layer (Step D). Evaporation through a second stencil mask 506 of a metal 507 is then used to form contact pads (Step E), to which bond wires 508 are attached (Step F).

It will be appreciated that the invention provides for a simple method of fabricating miniature electron multipliers, in an in-plane configuration suitable for use with miniature analytic instruments such as mass filters. The materials involved are predominantly silicon and compatible oxides, allowing the possibility of integration with a mass filter formed in a similar materials system. The materials are selected simultaneously to withstand high voltages and to enhance secondary electron emission. Fabrication is based on standard planar processing methods. These methods also allow the construction of an integrated set of bias resistors in a multi-electrode device, so that the device may be operated from a single high-voltage source. These methods also allow the construction of a number of resistor chains formed from a number of sets of integrated resistors in alternative biasing arrangements.

It will be appreciated that the present invention provides a planar structure adapted to provide an electron multiplier. An initial device electrode is formed in silicon and is biased to provide a secondary stream of electrons from an incoming positive ion. These secondary electrons may be multiplied by impact with one or more electrodes formed in a plane parallel to the substrate before they are extracted from a termination electrode. Desirably the formation of the multiple electrodes in a silicon structure enables the incorporation of such a device with one or more other compatible devices such as mass filters. As such although the present invention has been described with reference to specific exemplary embodiments it will be appreciated that it is not intended to limit the present invention in any way except as may be deemed necessary in the light of the appended claims.

REFERENCES

Fijol J. J., Then A. M., Tasker G. W., Soave R. J. "Secondary electron yield of $SiO_2$ and $Si_3N_4$ thin-films for continuous dynode electron multipliers" Appl. Surf. Sci. 48-49: 464-471 (1991)

Beetz C. P., Lincoln B., Winn D. R., Segall K., Vasas M., Wall D. "Diamond film optical, X-ray and particle detectors" IEEE Trans. Nucl. Sci. 38, 107-109 (1991)

Ehrfeld W., Münchmeyer D. "3-dimensional microfabrication using synchrotron radiation" Nucl. Instrum. & Meth. A303, 523-531 (1991)

Guckel H. "High-aspect-ratio micromachining via deep X-ray lithography" Proc. IEEE 86, 1586-1593 (1998)

Bean K. E. "Anisotropic etching of silicon" IEEE Trans. Electron Devices ED-25, 1185-1193 (1978)

Laermer F., Schilp A. "Method of anisotropically etching silicon" U.S. Pat. No. 5,501,893 Mar. 26th (1996)

Hynes A. M., Ashraf H., Bhardwaj J. K., Hopkins J., Johnston I., Shepherd J. N. "Recent advances in silicon etching for MEMS using the ASE™ process" Sensors and Actuators 74 13-17 (1999)

Ehrfeld W., Moser H., Muenchmeyer D. "Micro secondary electron multiplier" U.S. Pat. No. 4,990,827 Feb. 5 (1991)

Fukuda D.; Inoue M., Takahashi H., Nakazawa M., Kawarabayashi J., Hirata Y., Numazawa T., Haga T. "Development of a micro-array-type electron multiplier" Nucl. Instrum. Meth. A436, 196-200 (1999)

Inoue M., Fukuda D., Takahashi H., Nakazawa M., Kawarabayashi J., Hirata Y., Numazawa T., Haga T. "Development of a new position sensitive electron multiplication device fabricated by LIGA process" Microsystems Technologies 6, 90-93 (2000)

Washington D., King H., Stubberfield P. M. "Electron multipliers" U.S. Pat. No. 4,482,836 Nov. 13 (1984)

Then A. M., Bentley S. "Method for fabrication of discrete dynode electron multipliers" U.S. Pat. No. 5,618,217 Apr. 9 (1997)

Steinbeck J., Winn D. R., Beetz C. P. Jr., Boertsler R. W. "Microdynode integrated electron multiplier" U.S. Pat. No. 6,384,519 May 7 (2002)

Beetz C. P. Jr., Boertsler R. W., Steinbeck J., Winn D. R. "Silicon etching process for making microchannel plates" U.S. Pat. No. 5,997,713 Dec. 7 (1999)

Then A. M., Shank S., Soave R. J., Tasker G. W. "Fabrication of a microchannel plate from a perforated silicon" U.S. Pat. No. 5,544,772 Aug. 13 (1996)

Then A. M., Snider G. L., Soave E. J., Tasker W. "Microfabricated electron multipliers" U.S. Pat. No. 5,568,013 Oct. 22 (1996)

Shank S. M, Soave R. J., Then A. M., Tasker G. W. "Fabrication of high aspect ratio structures for microchannel plates" J. Vac. Sci. Tech. B13, 2736-2740 (1995)

Beetz C. P., Boerstler R., Steinbeck J., lemieux B., Winn D. R. "Silicon-micromachined microchannel plates" Nucl. Instrum. & Meth. A442, 443-451 (2000)

Darling R. B., Scheidemann A. A., Bhat K. N., Chen T. C. "Micromachined Faraday cup array using deep reactive ion etching" Sensors and Actuators A95, 84-93 (2002)

Badman E. R., Cooks R. G. "Special feature: Perspective—miniature mass analysers" J. Mass. Spect. 35, 659-671 (2000)

We claim:

1. A MEMS electron multiplier device comprising:

a) a substrate formed at least partially from an insulating material, b) a semiconducting material provided on an upper surface of the substrate, c) a plurality of electrodes formed by selectively etching the semiconducting material, at least one of the electrodes having an emissive surface and being adapted to provide, in use, secondary electron emission on interaction of the emissive surface with one or more electrons, and wherein the plurality of electrodes are formed with their emissive surfaces substantially perpendicular to the insulating substrate.

2. A device as in claim 1, in which the electrodes are geometrically arranged and electrically biased to operate by cascaded emission of secondary electrons in a direction parallel to the substrate plane.

3. A device as in claims 1, in which the semiconducting material is silicon.

4. A device as in claim 1 wherein the electrodes are provided by deep reactive etching, the etching of the semiconducting material effecting the formation of a plurality of upstanding elements having side walls upon which, in use, the electrons are incident thereupon.

5. A device as in claim 4, in which the electrode etching is carried out to different depths in different regions.

6. A device as in claim 1 in which each of the electrodes are formed as a Venetian blind structure, each of the blinds having a plurality of elements, the individual elements of each blind being electrically coupled to one another.

7. A device as claimed in claim 6 wherein each of the plurality of elements defining a Venetian blind structure is coupled to an adjacent element of the Venetian blind structure by a bridge formed in the semiconducting material.

8. A device as claimed in claim 6 wherein each of the elements forming a Venetian blind structure is formed at an angle offset from the intended path of incoming electrons thereby increasing the probability of interaction with incoming electrons.

9. A device as in claim 1 in which the electrodes are provided in a geometry comprising a series of planar or curved surfaces.

10. A device as claimed in claim 1 in which the insulating material is selected from one or more of glass, silica, or oxidised silicon.

11. A device as claimed in claim 1 wherein each of the plurality of electrodes are formed by etching techniques.

12. A device s as claimed in claim 11 wherein the semiconducting surfaces of the formed electrodes are oxidised after etching, thereby providing an oxide coating on the electrodes.

13. A device as claimed in claim 12 wherein the oxide coating is doped with an additional material to enhance secondary electron emission.

14. A device as in claim 12, in which the oxide surface is annealed in hydrogen to enhance secondary electron emission.

15. A device as claimed in claim 1 in which a first electrode of the plurality of electrodes is electrically biased to act as a conversion dynode for positive ions, thus enabling the device to act as a positive ion detector.

16. A device as in claim 1 in which the first electrode of the plurality of electrodes is electrically biased to act as a conversion dynode for negative ions, thus enabling the device to act as a negative ion detector.

17. A device as in claim 1, in which adjacent electrodes are electrically coupled to one another by a series of semiconducting links.

18. A device as in claim 17 wherein the semiconducting links are connected to act as bias resistors.

19. A device as in claim 18 wherein the bias resistors form a set of resistors linking and biasing a dynode chain.

20. A device as in claim 1, in which the links are oxidised, the oxidation of the links being used to increase the effective resistance of the semiconducting links.

21. A device as claim 1, in which two multiplier devices are combined by stacking to double the effective input aperture.

22. A device as claimed in claim 1 wherein the electrodes are provided with an additional photo-emissive layer capable of ejecting an electron when struck with a photon such that the device may be used to detect X-rays and/or photons.

* * * * *